United States Patent [19]

Geier

[11] 4,192,547

[45] Mar. 11, 1980

[54] ROCKING CHAIR FRAME

[76] Inventor: James M. Geier, 2 Howard St., Burlington, Vt. 05401

[21] Appl. No.: 821,517

[22] Filed: Aug. 3, 1977

Related U.S. Application Data

[63] Continuation-in-part of Ser. No. 758,584, Jan. 12, 1977.

[51] Int. Cl.[2] ..... A47C 7/02; A47C 3/02

[52] U.S. Cl. ..... 297/452; 5/190; 297/445; 297/458

[58] Field of Search ..... 5/120, 236 B, 190, 188; 52/108, 676, 227; 160/164, 130, 185, 229 R, 236; 297/440, 445, 452, 458

[56] References Cited

U.S. PATENT DOCUMENTS

| | | | |
|---|---|---|---|
| D. 172,858 | 8/1954 | Yellen | D6/70 |
| 390,393 | 10/1888 | Norris | 5/120 |
| 1,091,164 | 3/1914 | Rechnitz | 52/676 |
| 2,551,976 | 5/1951 | Smith | 5/236 B |
| 3,706,473 | 12/1972 | Mullen | 297/440 |
| 3,987,534 | 10/1973 | Gold | 108/153 X |

FOREIGN PATENT DOCUMENTS

| | | | |
|---|---|---|---|
| 615947 | 7/1935 | Fed. Rep. of Germany | 297/445 |
| 878437 | 6/1953 | Fed. Rep. of Germany | 5/190 |
| 14512 | of 1894 | United Kingdom | 5/120 |

*Primary Examiner*—James T. McCall
*Attorney, Agent, or Firm*—R. Lewis Gable

[57] ABSTRACT

A chair and method of manufacture is disclosed to provide a seat and backrest formed of a plurality of blocks strung on a single piece of rope between a pair of opposed side panels. Each side panel includes a backrest portion extending generally vertically, a seat support portion extending at an angle with respect to the backrest support portion and generally horizontal with respect to the ground, and a pair of legs extending from the seat support portion toward the ground. The blocks are strung in a series of generally parallel rows disposed between the side panels. In particular, each row includes a plurality of blocks suspended from the rope in a manner to permit the blocks to move freely along the rope and to provide a flexible support surface in a direction generally perpendicular to the length of backbone of the person resting in the chair. Thus, though the substance of the side panels and the blocks is hard, a flexible support surface is given to the person sitting in the chair, giving that person a sensation that the chair is soft. Further, if the rope becomes stretched as through use, one end of the rope may be loosened and tension reapplied to the rope before resecuring the one end to its side panel.

10 Claims, 5 Drawing Figures

Fig 3.A.
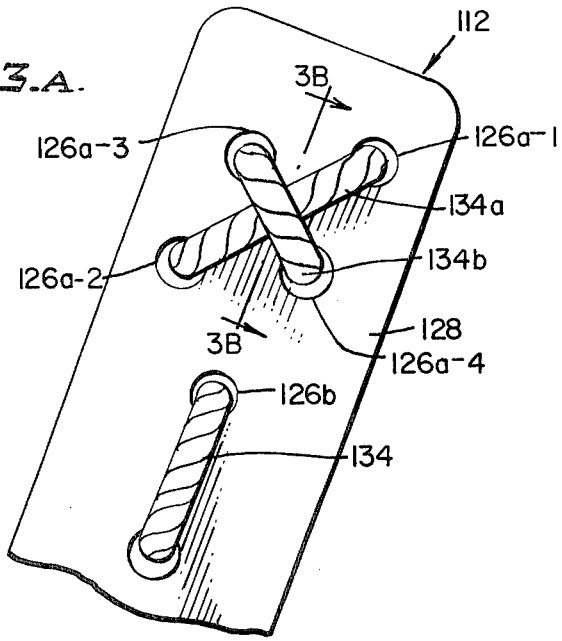
Fig 3B.
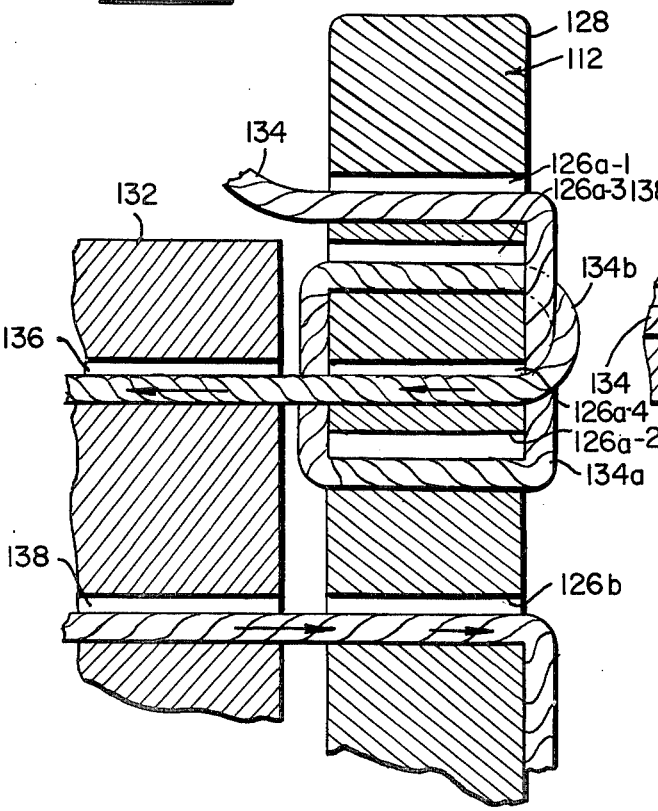
Fig 4.
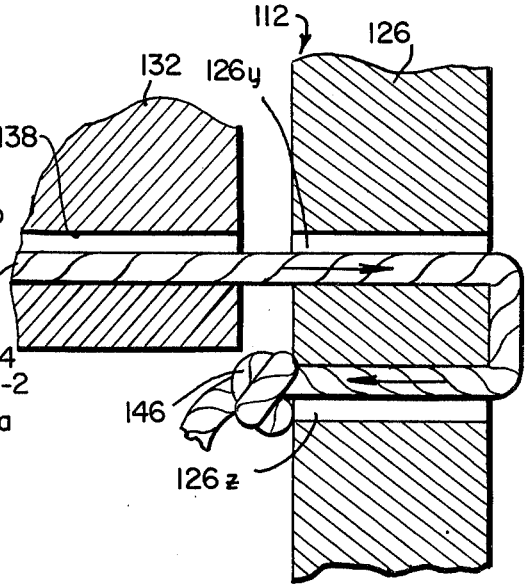

ROCKING CHAIR FRAME

CROSS-REFERENCE TO RELATED APPLICATION

This is a continuation-in-part of application Ser. No. 758,584, filed Jan. 12, 1977, entitled ROCKING CHAIR FRAME.

BACKGROUND OF THE INVENTION

The present invention is directed to a chair and a method of its construction. The primary purpose of the chair of the present invention is to provide a chair construction where the suspended supporting surface is constructed of rigid blocks strung by a rope between the side panels of the chair in such an arrangement to flex and conform to the posture of a sitting person.

In constructing chairs designed for casual or outdoor use that may be subject to hard use or the outdoor elements, it is not feasible to use padding or stuffing materials to provide comfort for the person sitting in the chair; rather, such chairs may be made of hard, rigid materials or may be made of a flexible fabric stretched between rigid side panels. The problem with each of these chair constructions is that the supporting surfaces do not provide a comfortable seating surface. Prolonged sitting on a hard rigid surface is not normally comfortable and can lead to backaches and, on occasion, more serious back problems. While prolonged sitting on a flexible fabric surface may be more comfortable than sitting on a hard surface back problems can also develop since the back is not properly supported. In addition, quite often chairs with flexible fabric supporting surfaces are difficult to arise from and in particular, where the weight of the person actually stretches the fabric forming a basket-like shape which hangs below the supporting frame; further, chairs with fabric supporting surface do not generally provide the strength that chairs formed entirely of rigid materials do. U.S. Pat. No. 3,909,064 issued to Payne et al. is directed to a chair construction where a plurality of rigid slats padded with a foamed plastic and covered with a canvas material extend between opposite side panels forming the seat and backrest supporting surface. Even though the slats are padded to provide a comfortable supporting surface the fact remains that the slats are hard and rigid and do not conform to the posture of a person.

British Pat. No. 14,512 issued July 28, 1894, is directed to a flexible chair supporting surface including a plurality of hard rigid slats strung in a vertical direction between the head rest and the front cross member of the chair seat. While the slats are strung on a rope and do flex, they can only flex in one direction in relation to a person's sitting posture, therefore providing only partial comfort.

U.S. Pat. No. 390,393 issued to Norris is directed to a hammock which includes a plurality of interfitting slats strung on a rope and designed to flex by pivoting on a supporting rope.

Other prior U.S. patents which disclose rigid slats strung on a rope to provide a supporting surface include U.S. Pat. Nos. 374,472 issued to Hartman, 2,551,976 issued to Smith and 2,745,473 issued to Boland.

In reviewing the above-mentioned patents, it is particularly noted that many of the above described constructions take the form of a plurality of slats suspended to extend generally perpendicular to the backbone or to the length of a person sitting in the chair. Significantly, such slats provide a rigid support in a direction across the person's body, thus not conforming to the body of a person sitting in the chair.

U.S. Pat. No. Des. 172,858 does show a plurality of blocks suspended in rows to form a seating surface for a chair construction. However, said blocks are suspended by horizontal and vertical straps whereby the blocks appear to be held in a relatively rigid fashion to permit but a limited amount of flexing to contour to the body of the person sitting within the chair. Further, it appears that the straps that are disposed in rows and columns are affixed at each end to rigid support members and if in the course of continued use these straps do stretch, there is no provision for retensioning them. Further, two support members extend in a direction perpendicular to the body of the person sitting within the chair, thus preventing those blocks suspended close thereto, from fully flexing with respect to the person's body.

The prior art also includes a chair construction including a pair of side panels and a backrest and seating portion formed of a plurality of blocks suspended between the side panels by a rope. In such construction, the rope extends between the side panels and suspends the blocks in rows thereof. In particular, the rope extends through openings within the blocks and knots are formed within the rope between each of the blocks in a row. Thus, the blocks are not free to move longitudinally along the length of the rope and are limited as to their flexibility in conforming to the body of the person sitting in the chair. It is also desirable to permit the person sitting in the chair to reform or reshape various portions of the chair to fit his own individual body, which is prevented in that each block and row of blocks is permitted a limited amount of flexing and movement with respect to the body of the person sitting in the chair. Further, after prolonged use of the chair, the rope suspending the blocks may be stretched so that portions of the chair may unduly sag. In a chair where knots are inserted between each block, it is impossible to reapply tension to the rope to recondition the chair structure and to eliminate sagging that may occur.

SUMMARY OF THE INVENTION

It is an object of this invention to provide a new and improved chair construction of improved design which includes a flexible suspended supporting surface of rigid blocks suspended from a chair frame.

It is still a more particular object of this invention to provide a new and improved chair for providing a support surface that is flexible in a direction substantially perpendicular to the length or the backbone of the person sitting in the chair, whereby a surface is made to conform to the rounded back and leg portions of the person sitting in that chair.

It is a still further object of this invention to provide a new and improved chair wherein a continuous cord used to suspend blocks in a manner to form a flexible surface, may be retensioned, if stretched after a period of prolonged use.

In accordance with these and other objects, there is provided a new and improved chair which includes a suspended supporting surface which includes a seat and back rest formed of a plurality of blocks strung together on a rope between a pair of opposed side panels. The improved suspended supporting surface includes a plurality of rows of relatively rigid blocks strung by a flexible cord or rope between the opposed side panels, each row including a plurality of such blocks, whereby each row extending in a direction substantially perpendicular to the length or backbone of the person sitting in the chair conforms to the roundness of his body. In addition, each block has an opening through which the cord passes in a manner to permit the block to move freely along the length of the cord to provide additional flexibility in the support given to the person's body.

In a further aspect of this invention, a single, continuous cord or rope extends in a serpentine fashion between the side panels to support the aforementioned rows of blocks. In particular, each side panel has a plurality of holes therein, whereby the cord extends from a first hole in one side panel through a first opening in each block of that row and subsequently through a corresponding first hole of the second side panel. Thereafter, the direction of the rope is reversed so that it extends through a second hole in the second side panel, a second opening in each block of the first row, and through a corresponding second hole of the first side panel. Subsequent rows of blocks that form the flexible seating surface, are formed in a similar fashion, whereby a support surface is made flexible in a direction substantially perpendicular to the length or backbone of the person sitting in the chair. By use of a continuous cord that is permitted to be drawn relatively freely through the holes formed within the first and second side panels, the person sitting in such a chair may reshape various portions of the seating and backrest portions to conform to his body. In addition, if the rope becomes stretched through prolonged use, it may be retensioned so as to eliminate sags that may have developed in the chair.

DESCRIPTION OF THE DRAWINGS

Other objects and advantages of this invention will become apparent from the following detailed description thereof and the accompanying drawings, wherein:

FIG. 3A shows a side view of an upper portion of one of the side panels of the chair shown in FIG. 1, illustrating the manner in which an end of the rope may be secured thereto;

FIG. 3B is a detailed sectional view taken along the line 3B—3B of FIG. 3A and showing the openings and associated line threading as being rotated to the plane of the sectional line for the purpose of clarity; and FIG. 4 shows the manner in which a remote end of the rope suspending the blocks from the side panels may be terminated in a knot not readily visible.

DETAILED DESCRIPTION OF THE PREFERRED EMBODIMENT

Figure 1:
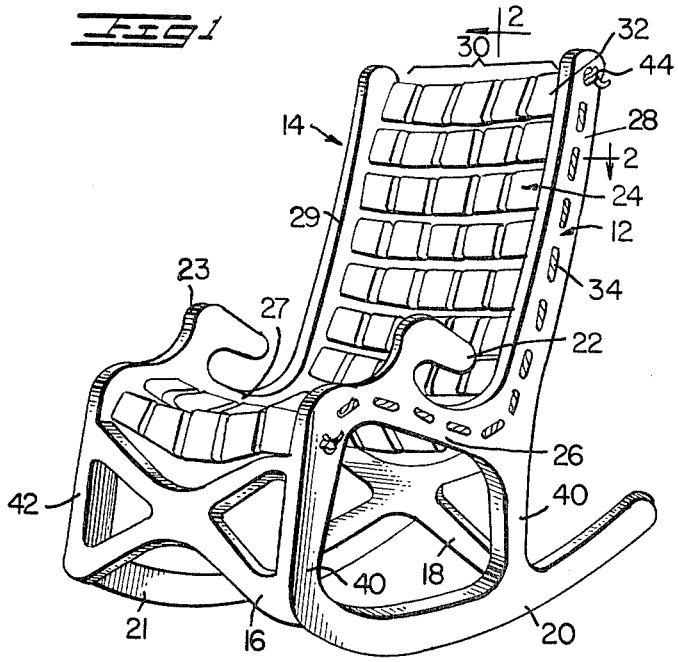
FIG. 1 is an isometric view of an improved chair construction in accordance with the teaching of this invention.

Referring now to the drawings and in particular FIG. 1, the chair construction according to the present invention includes a chair indicated generally at 10, having two side panels or support members 12 and 14, respectively, joined together in a spaced relationship by rigid cross members 16 and 18. The side panels 12 and 14 include, respectively, backrest support portions 28 and 29, extending in a generally vertical direction, as shown in FIG. 1, and seat support portions 26 and 27, respectively, extending in a generally horizontal fashion with respect to the ground. A first pair of legs 40 extends from the seat support portion 26 downward toward the ground, while a second pair of legs 42 (only one appears in FIG. 1) extends from the support portion 27 of the second side panel 14 toward the ground. In an illustrative embodiment of this invention, arcuate rocker member 20 is connected to the pair of legs 40 of the first side panel 12, while an arcuate rocker member 21 is connected to the legs 42 of the second side panel 14. It is understood that the legs 40 and 42 are adaptable to either a rocking chair, stool or a stationary chair; thus, this invention is not limited to a rocking-type chair. The chair assembly includes a pair of rigid cross members 16 and 18 disposed between the side panels 12 and 14 to fix the panels in substantially parallel relationships. Each of the rigid cross members 16 and 18 is X-shaped in construction which when connected to the side panels 12 and 14 as shown in FIG. 1 provides a chair frame capable of supporting the suspended supporting surface 24, as will be described in detail later.

Figure 2:
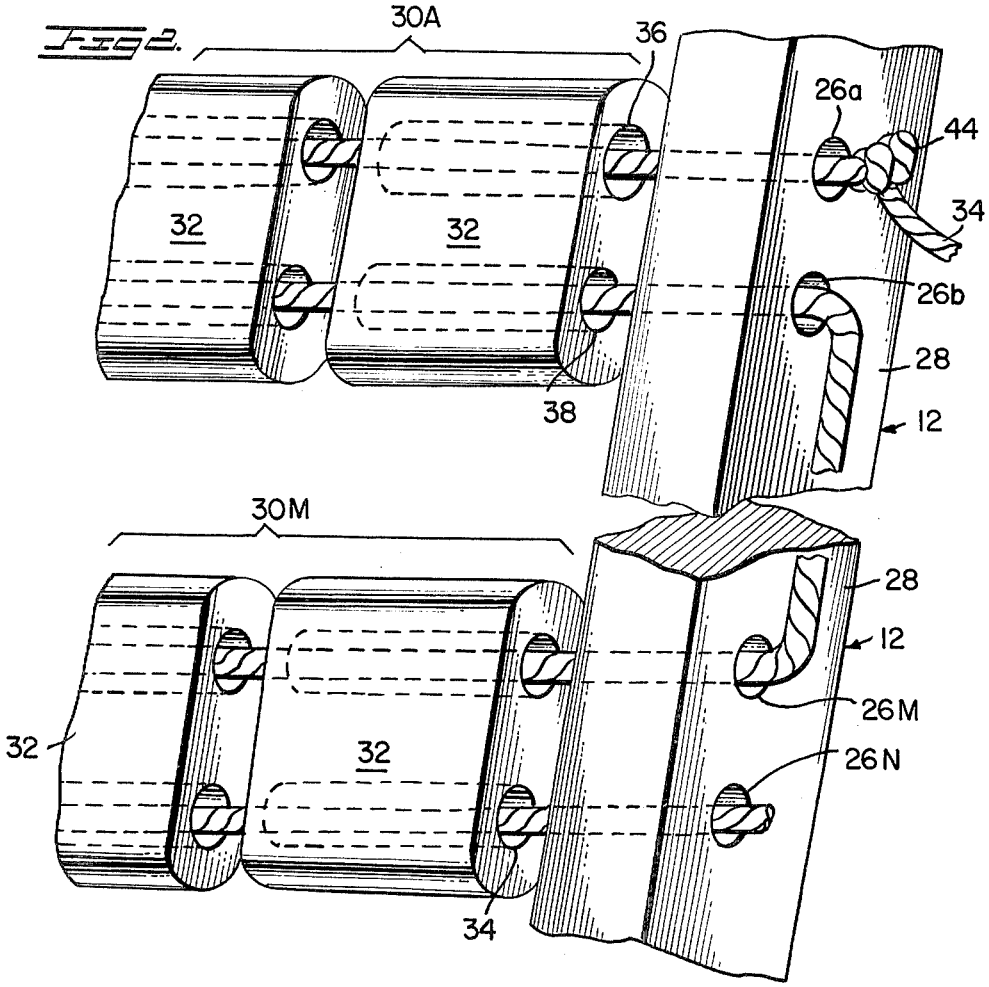
FIG. 2 is an exploded view of the right, top-most portion of the chair shown in FIG. 1.

As shown in FIG. 2, the side panel 12, as well as the side panel 14, have a plurality of equally spaced apertures or holes 26 aligned one above the other, for supporting the suspended supporting surface 24 as shown in FIG. 1. The holes 26 extend along the length of each of the backrest support portions 28 and 29 and along the seat support portions 26 and 27 to form a continuous line as shown in FIG. 1, whereby a substantially continuous support surface 24 may be formed.

The support surface 24 is suspended from the frame comprises of the side panels 12 and 14 by means of a rope or cable 34, as more particularly shown in FIG. 2. As shown in FIGS. 1 and 2, the support surface 24 is made up of a plurality of individual blocks 32 suspended by the rope 34. Each block 32 has first and second passages 36 and 38, extending in a generally parallel fashion therethrough, as shown in FIG. 2. To assemble the blocks 32 of the support surface 24, the rope 34 is knotted at a first end to form a first knot 40, and then threaded through a first, topmost hole **26*a*, thereafter being directed through the first openings 36 of the block 32 of the first row 30*a*. Thereafter the rope 34 is disposed through a corresponding first hole (not shown) of the backrest portion 29 of the second side panel 14. Illustratively, five to seven blocks 32 are so suspended to form one of the rows 30. Thereafter, the rope 34 is threaded through a second hole immediately below the first hole of the backrest support portion 28, corresponding to a second hole 26*b* of the side panel 12, and thereafter directed through the second openings 38 of the blocks 32 of the first row 30*a*, to be threaded through the second hole 26*b* of the side panel 12. In this fashion, the first row 30*a* of block 32 is formed. The holes 26*a* and 26*b* corresponding to the first row are spaced illustratively 2 inches apart. The rope 34 is directed to a third hole 26*c*, (not shown), spaced illustratively 2 inches below the second hole 26*b*, and a second row of blocks is strung between the side panels 12 and 14 in a manner similar to that already described. This manner of threading the rope 34 between the side panels 12 and 14 and through the blocks 32 in a serpentine fashion back and forth between the panels 12 and 14 continues until a suspended supporting surface 24** is formed in a shape similar to the chair frame.

Thus, in a first aspect of this invention, it is seen that rows 30 of blocks 32 are formed with each row directed in a direction substantially perpendicular to the length or backbone of the person sitting in the chair and with each block 32 permitted to move along the length of the rope 34 so that a flexible support surface is provided in this direction to conform to the curvature of the person's body. Thus, even though the blocks 32 are formed of a relatively rigid material, the person sitting in the chair senses a soft, relatively flexible surface as provided by blocks so suspended. In a further aspect of this invention, the seating surface is supported by an uninterrupted piece of rope or cable that can be easily tightened after years of use, to its original firmness. As shown in FIG. 2, either the initial knot 40 or a final knot 46, as shown in FIG. 1, may be formed. Thus, after an extended period of use, it is expected that the rope 34 would stretch and that a retensioning of the rope 34 may be effected by unknotting one of the knots 46 or 44 and pulling on the rope until the desired degree of tension is secured, whereafter that knot is retied. In addition, the person sitting in the chair 10 is able to lengthen the portions of the rope 34 suspending particular rows 30, while shorteneing other rope portions, whereby the support surface 24 is reconfigured to the body of the person sitting in the chair.

In FIG. 1, the terminations at the end of the rope 34 are shown as knots 44 and 46, respectively. In order to permit easier untying of the end of the rope 34 from the side panels, as well as to improve the appearance of the chair, the terminations or knots at the ends of the rope 34 may be configured as shown in FIGS. 3A and 3B, and 4. In FIGS. 3A, 3B and 4, numerals similar to those shown in FIGS. 1 and 2, but in the 100's series, are used to designate corresponding elements. In FIGS. 3A and 3B, the rope 134 is threaded selectively through four openings **126*a*-1 to 126*a*-4, with the end of the rope 134 disposed upon a inside surface of the side panel 112, so as not to readily seen. In particular, the cord 134 is first threaded through the opening 126*a*-1 and is redirected through the second opening 126*a*-2 leaving a first rope segment 134*a* extending therebetween. At the other side of the side panel 112, the rope 134 is directed upward, as seen in FIG. 3B, to be threaded through the third opening 126*a*-3. Thereafter, the rope 134 is directed to the fourth opening 126*a*-4, disposing a second rope segment 134*b* to overlap the first rope segment 134*a* that exerts a pressure thereon and holds the first rope segment 134*a* in a frictional engagement with the side of the side panel 112; as a result the end of the rope 134 may not be withdrawn from the side panel 112. In a fashion similar to that explained above, the rope 134 is directed through the fourth opening 126*a*-4 and through the first opening 136 of the block 132 within the first row of such blocks. The rope 134 is looped through, as explained above, openings within the second side panel and is directed back to be threaded through the second opening 138 of the block 132, then to be threaded through the next opening 126*b* within the side panel 112**.

In FIG. 4, there is shown a further embodiment wherein the other end of the rope 134 is terminated in a manner to improve the design of the chair 10. As shown, the end of the cord is threaded through the second opening 138 of the blocks 132 of the last row, then to be directed through a penultimate hole **126*y* to be looped about and to be redirected through the last hole 126*z* within the side panel 126. Tension is exerted upon the end of the cord 134 and a knot 146 is placed within the end of the cord 134, the knot 146 being on the inside of the side panel 112** and thus not normally visible.

The advantage of the termination configuration as shown in FIGS. 3A and 3B is that it is relatively easy to loosen the cord 134 to permit a retensioning of the cord 134 as by withdrawing the cord 134 from the four openings **134*a*-1 to 134*a*-4. However, in a preferred embodiment of the invention, such a configuration of the four openings would not normally be used to effect the securing of the bottom end of the cord 134 in that the four openings would to some degree weaken the side panel 112 at a point where the weight of the person sitting in the chair, is exerted. On the other hand, the topmost portion of the side panels 112 as seen in FIG. 3A does not receive such tension and the forming of the holes 126*a*-1 to 126*a*-4** does not present a hazard.

Numerous changes may be made in the above-described apparatus and the different embodiments of the invention may be made without departing from the spirit thereof; therefore, it is intended that all matter contained in the foregoing description and accompanying drawings shall be interpreted as illustrative and not in a limiting sense.

What is claimed is:

1. A chair for receiving a person comprising:

(a) first and second support members each having a back support portion extending generally vertically and a seat support portion extending generally horizontally, and a series of holes extending along the lengths of said back and seat support portions;

(b) means disposed between said first and second support portions for fixedly supporting said first and second support members in a substantially parallel relationship with each other; and (c) support surface means comprising flexible rope means for suspending blocks in a plurality of rows thereof, each block being made of a hard material, each row comprised of a plurality of blocks extending between said first and second support members in a direction substantially perpendicular to the length ofthe person sitting in the chair and suspended at each end by said support members, and each of said blocks having an opening therethrough for receiving said rope means, and being of a small dimension relative to a lateral dimension along the direction of the person and being loosely suspended upon said rope means to move freely therewith, whereby each row of blocks provides a surface flexible in said direction and conforming to the body of the person sitting in the chair.

2. The chair as claimed in claim 1, wherein each of said blocks comprises said first-mentioned and second substantially parallel openings directed through said blocks for receiving said rope means, said rope menas comprises a continuous rope threaded through said holes within said first and second support members and said first and second openings within said blocks, in a serpentine fashion, back and forth between said support members to form said plurality of blocks.

3. The chair as claimed in claim 2, wherein said holes within said first and second support members are substantially equally spaced from each other.

4. A chair for receiving a person comprising:

(a) first and second support members, each comprised of a back support portion and a seat support portion, and having a series of holes therethrough extending along the length of said seat and said back support portions;

(b) means disposed between said first and second support members for fixedly supporting said support members in a substantially parallel relationship to each other;

(c) surface support means comprised of a plurality of blocks, each made of a relatively hard material and having an opening therethrough; and (d) a single cord extending freely through said holes of said first support member, through said openings of said blocks, and through said holes of said second support member in a serpentine configuration between said first and second support members, each of said blocks being of a small dimension relative to a lateral dimension of the person and being suspended on said cord, whereby said plurality plurality of blocks forms a flexible surface with respect to a person sitting in said chair.

5. The chair as claimed in claim 4, wherein each of said blocks comprises first and second openings extending substantially parallel with each other, and said cord extends in a first direction from said first support member to said second support member through said first openings of a plurality of blocks and in a second direction from said second support member to said first support member through said second openings of said blocks to form a row thereof.

6. The chair as claimed in claim 1, wherein said rope has a first end in which a knot is formed to secure said rope with respect to one of said first and second support members and a second knot is formed at said second end, thereby to secure said second end with respect to one of said first and second support members.

7. The chair as claimed in claim 1, wherein at least one end of said rope means is intertwined to form a knot and said knot is disposed upon an inside surface of one of said first and second support members adjacent to said surface means.

8. The chair as claimed in claim 1, wherein said rope means includes an end portion that is directed through an opening of one of said blocks and therefrom through a hole within one of said support members to be directed through the next hole within said one support member, and a knot formed within said rope means adjacent to said opening upon the interior surface of said side support member.

9. The chair as claimed in claim 1, wherein each of said blocks includes means for suspending said block from said rope means in a manner to permit a rotational movement of said blocks about said rope means and to permit a longitudinal motion of said blocks with respect to said rope means.

10. A chair comprising:

(a) first and second support members each having a back support portion extending generally vertically and a seat support portion extending generally horizontally, and a series of holes extending along the lengths of said back and seat support portions, at least one of said support members includes an end terminating portion wherein there is disposed at least four holes and including an interior surface and an exterior surface;

(b) rope means disposed between said first and second support portions for fixedly supporting said first and second support members in a substantially parallel relationship with each other;

(c) support surface means comprising flexible rope means for suspending blocks in a plurality of rows thereof, each block being made of a hard material, each row comprised of a plurality of blocks extending between said first and second support members in a direction substantially perpendicular to the length of the person sitting in the chair and suspended at each end by said support members, and means for suspending each of said blocks to move freely with respect to said rope means and comprising first and second substantially parallel openings directed through said blocks for receiving said rope means, whereby each row of blocks provides a surface flexible in said direction and conforming to the body of the person sitting in the chair; and (d) said rope means having an end disposed adjacent to said interior surface of said one support member and extending therefrom through said first hole toward said exterior surface of said support member, and extending across said exterior surface to form a first segment, said rope means extending through said second opening toward said inside surface, said rope means further being redirected through said third opening toward said exterior surface to provide a second segment extending over said first segment of said cord and into said fourth opening, said rope means extending through said fourth hole and into said first opening of one of said plurality of blocks, said second segment of said cord exerting pressure upon said first segment whereby said end of said rope means is secured to said support member.

* * * * *